US007371103B2

(12) United States Patent
McGrath et al.

(10) Patent No.: US 7,371,103 B2
(45) Date of Patent: May 13, 2008

(54) POSITIVE LOCKING LATCH FOR EDGE CARD CONNECTOR

(75) Inventors: James L. McGrath, Bloomingdale, IL (US); Kim Yong Tang, Singapore (SG); Ramesh Srinivasa Rao, Singapore (SG)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/449,307

(22) Filed: Jun. 8, 2006

(65) Prior Publication Data

US 2007/0287309 A1 Dec. 13, 2007

(51) Int. Cl.
*H01R 13/627* (2006.01)

(52) U.S. Cl. ..... 439/352; 439/327

(58) Field of Classification Search ..... 439/152, 439/153, 155, 157, 159, 160, 327, 352, 328
See application file for complete search history.

(56) References Cited

U.S. PATENT DOCUMENTS

| | | | | |
|---|---|---|---|---|
| 5,414,594 | A * | 5/1995 | Hristake | 439/152 |
| 5,730,611 | A | 3/1998 | Cheng et al. | |
| 6,126,471 | A * | 10/2000 | Yu et al. | 439/327 |
| 6,319,027 | B1 * | 11/2001 | Pickles et al. | 439/157 |
| 6,887,095 | B2 | 5/2005 | Simon et al. | |
| 6,932,633 | B2 | 8/2005 | Tsai | |

* cited by examiner

*Primary Examiner*—Felix Figueroa
(74) *Attorney, Agent, or Firm*—Robert J. Zeitler

(57) ABSTRACT

A connector, such as an edge card connector, is provided with positive locking ejection latches. The positive locking of the ejection latches ensure that an associated card inserted into the connector will not accidentally be ejected under shock and vibration conditions. To use the ejection latches, a locking member provided in association with the ejections latches must be disabled.

6 Claims, 6 Drawing Sheets

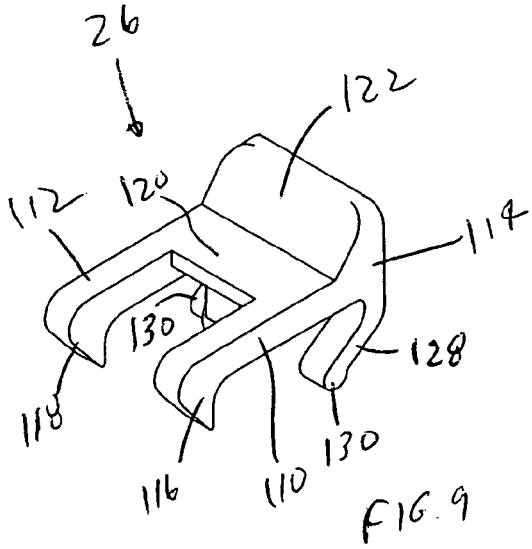
FIG. 9
FIG. 10
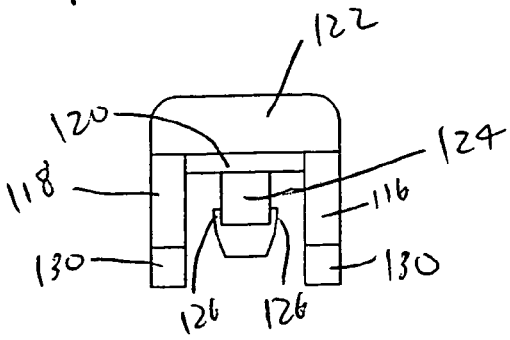
FIG. 11
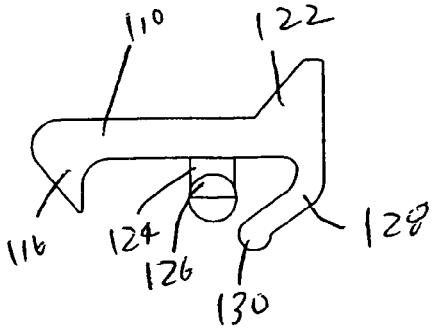

POSITIVE LOCKING LATCH FOR EDGE CARD CONNECTOR

BACKGROUND OF THE INVENTION

Prior art edge card connectors use latches to maintain an associated card within the connector. The latch is also used as a means to eject the card from the connector.

These types of connectors includes an elongated body which has a slot provided generally along the length thereof. A tower is provided at each end of the body and extends upwardly from the upper surface of the body. The tower has a slot into which the edges of the card are inserted. A respective latch is inserted into each tower.

When a card is engaged with the connector, a portion of the latch overhangs the slot in the tower and engages into a cutout in the card. A detent on the latch engages within a recess in the tower. To eject the card, the latch is pivoted outwardly from the tower provided sufficient force is applied to the latch to overcome the engagement of the detents within the recesses.

This structure is suitable for most applications. However, under certain conditions, such if a shock or vibration is applied to the connector, the latches may open, allowing the card to disengage from the connector.

SUMMARY OF THE INVENTION

Briefly, the present invention discloses a connector, such as an edge card connector, provided with positive locking ejection latches. The positive locking of the ejection latches ensure that an associated card inserted into the connector will not accidentally be ejected under shock and vibration conditions. To use the ejection latches, a locking member provided in association with the ejections latches must be disabled.

The connector includes a body having a slot capable of receiving an associated card, a tower provided at each end of the body, a latch pivotably mounted in each tower, and a locking member. The locking member is provided on each latch. The locking member pivots with the latch when the latch is pivoted, but the locking member is moveable relative to the latch. The locking member is engageable with the tower to prevent pivotal movement of the latch relative to the tower. The locking member is disengageable from the tower to allow pivotal movement of the latch relative to the tower.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which:

FIG. 9 is a perspective view of a locking member which is a component of the preferred embodiment of the connector;

FIG. 10 is a front elevational plan view of the locking member;

FIG. 11 is a side elevational view of the locking member;

DETAILED DESCRIPTION OF THE ILLUSTRATED EMBODIMENT

Figure 1:
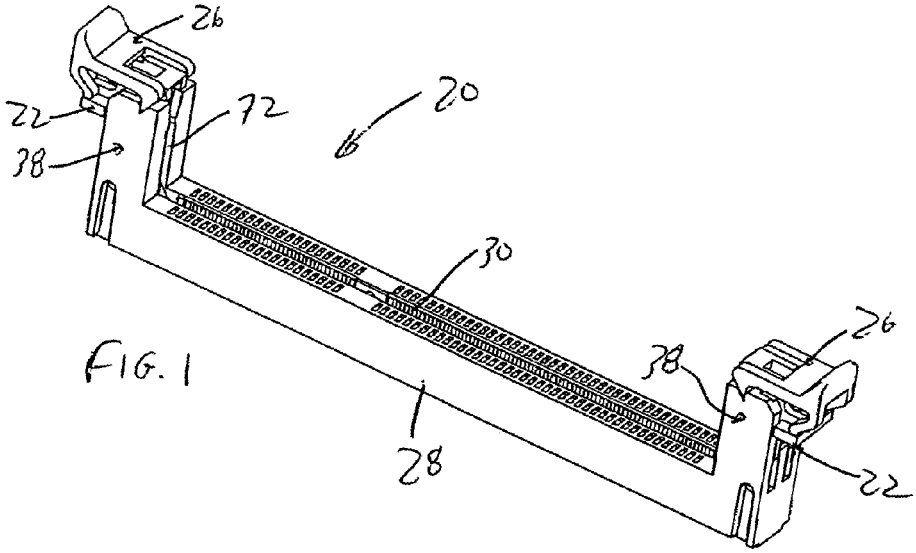
FIG. 1 is a perspective view of a connector which incorporates the features of the invention.
Figure 2:
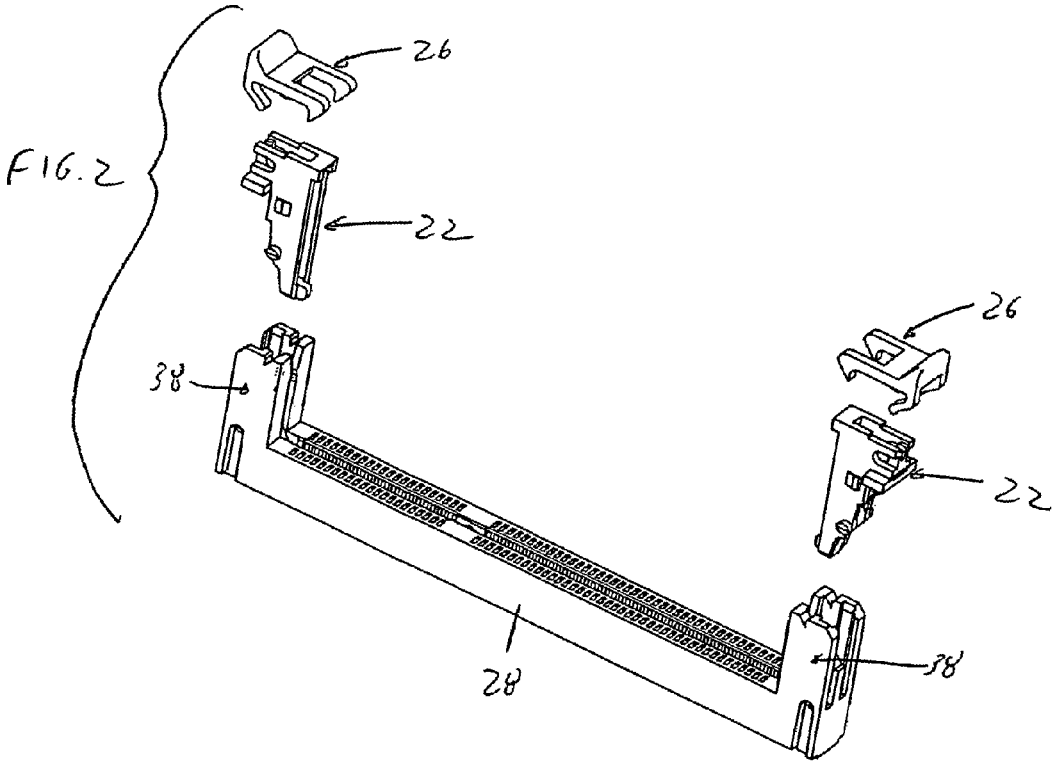
FIG. 2 is an exploded perspective view of the connector.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

A connector 20, such as an edge card connector, is provided with positive locking ejection latches 22. The positive locking of the ejection latches 22 ensure that an associated card 24 inserted into the connector 20 will not accidentally be ejected under shock and vibration conditions. To use the ejection latches 22, a locking member 26 provided in association with the ejections latches 22 must be disabled. The connector 20 is preferably formed of an insulative material, such as plastic.

The connector 20 includes an elongated body 28 which has a slot 30 provided generally along the length thereof. As a result, first and second walls 32, 34 are provided on each side of the slot 30. A plurality of spaced passageways 36 are provided through the walls 32, 34 from an upper surface thereof to a lower surface thereof.

Figure 3:
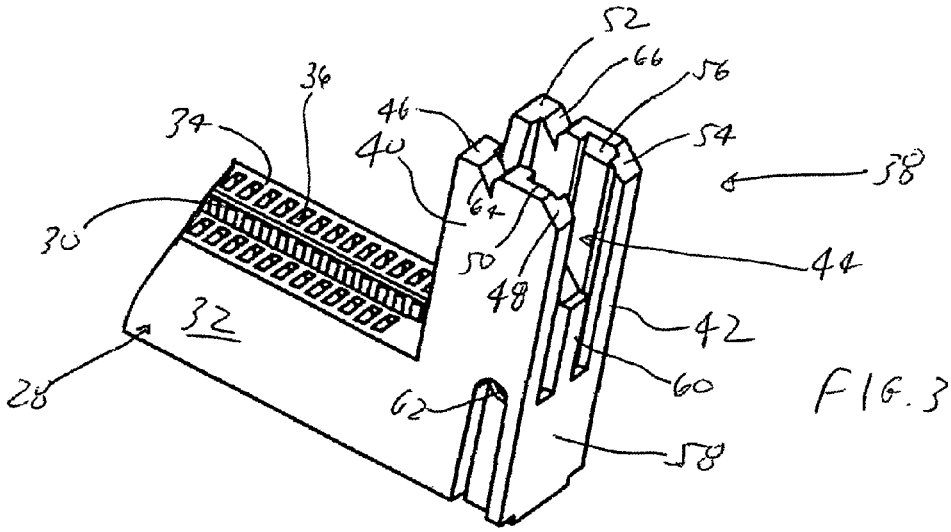
FIG. 3 is a perspective view of an end of the connector.
Figure 4:
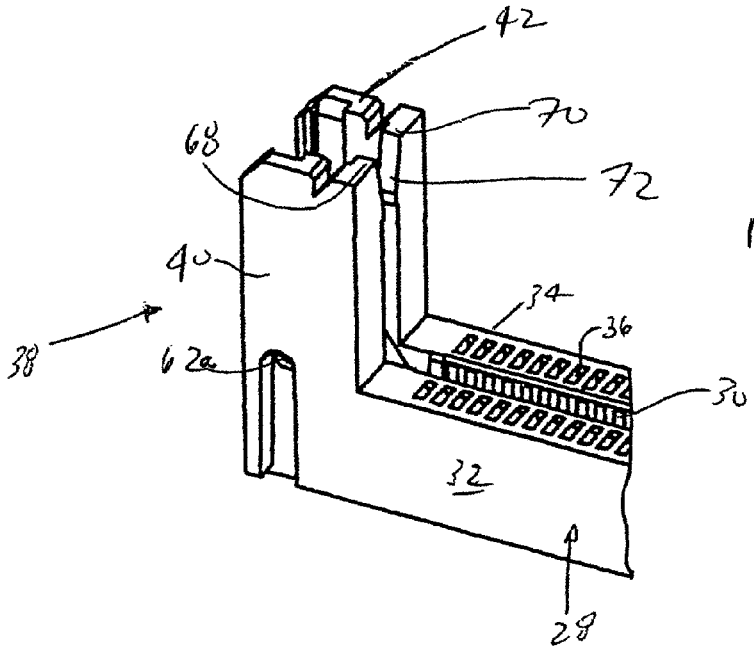
FIG. 4 is a perspective view of the other end of the connector.
Figure 6:
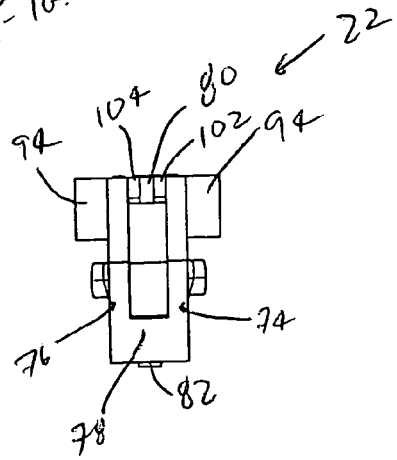
FIG. 6 is a top plan view of the latch.
Figure 5:
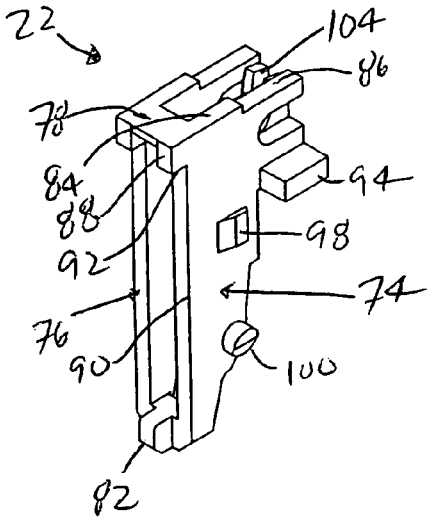
FIG. 5 is a perspective view of a latch which is a preferred embodiment of the component of the connector.
Figure 8:
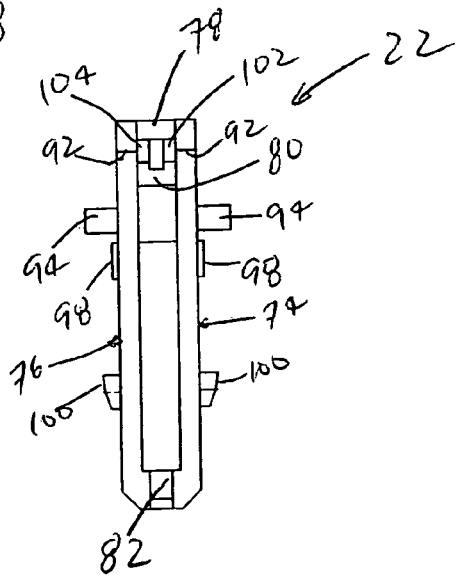
FIG. 8 is a front elevational view of the latch.
Figure 7:
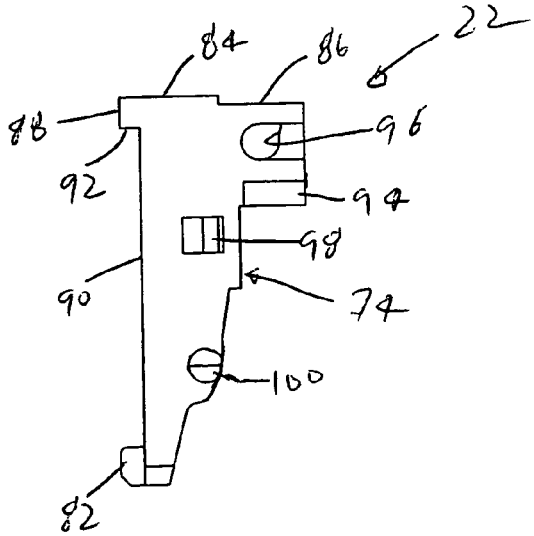
FIG. 7 is a side elevational view of the latch.
Figure 12:
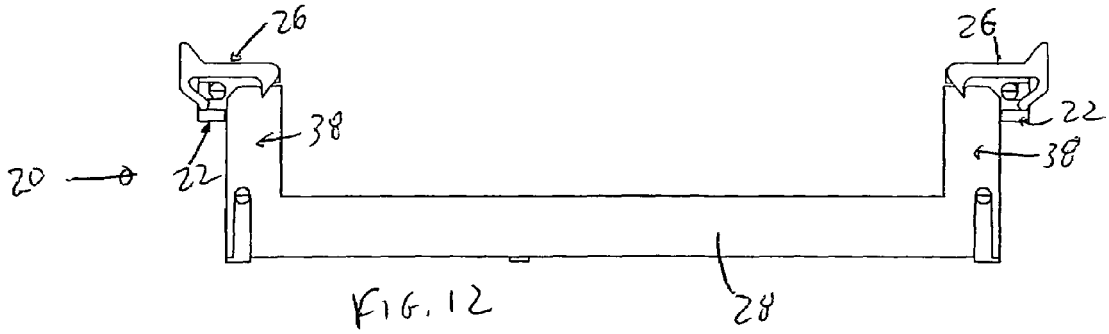
FIGS. 12-14 are side elevational views of the connector showing the connector in different conditions.
Figure 13:
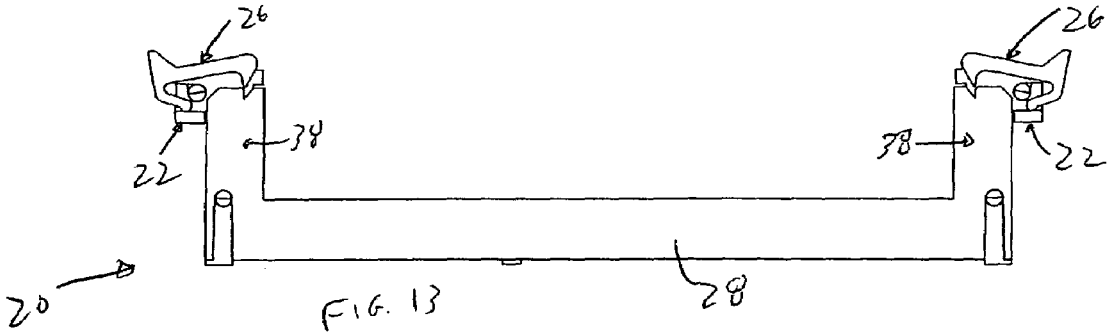
Figure 14:
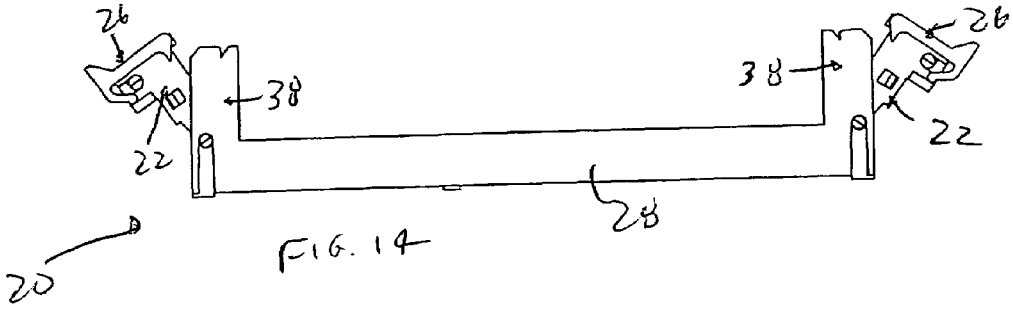
Figure 15:
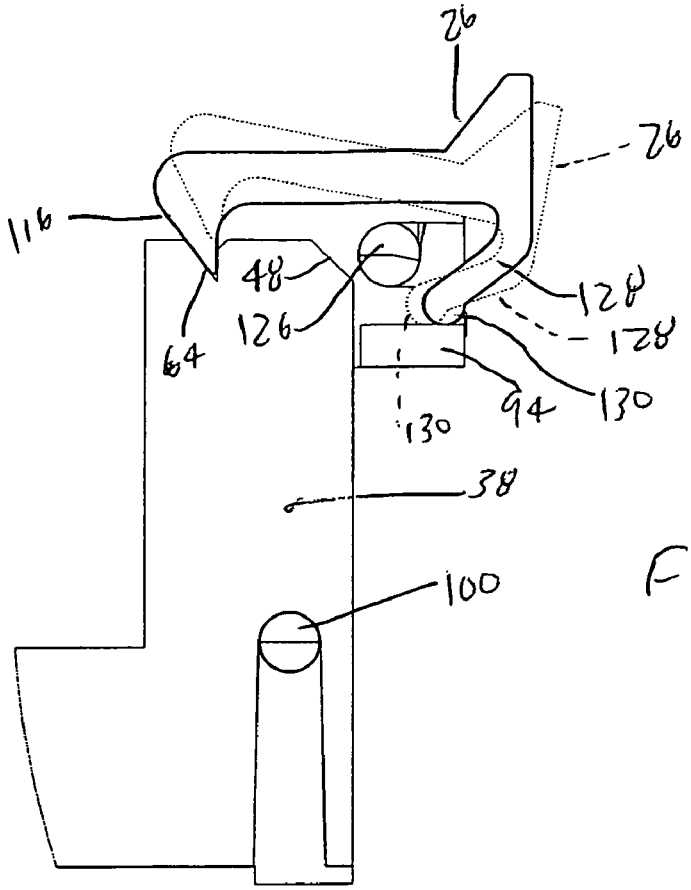
FIG. 15 is a side elevational view of a portion of the connector showing an engaged position in full line and a partially disengaged position in phantom line.
Figure 16:
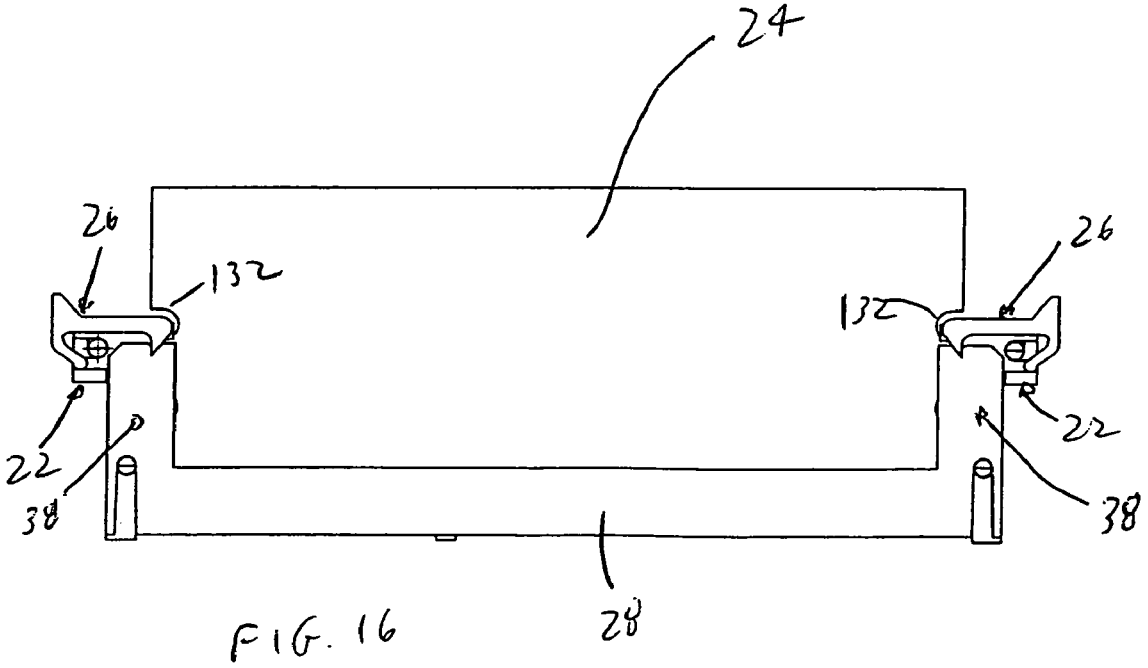
FIG. 16 is a side elevational view of the connector shown engaged with an associated card.

A tower 38 is provided at each end of the body 28 and extends upwardly from the upper surface of the body 28. The towers 38 are preferably integrally formed with the body 28 and are identical to each other. Therefore, only one of the towers 38 is described, with the understanding that the other tower 38 is identically formed. The structure of the towers 38 is best shown in FIGS. 3 and 4.

The tower 38 has first and second upstanding arms 40, 42 which have a cavity 44 defined therebetween. The first arm 40 is connected to and planar with the first wall 32 of the body 28 and is defined by an inner end which is proximate to the body 28, an outer end which opposite the inner end, a top surface 46 and inner and outer surfaces. A beveled surface 48 is provided between the top surface 46 and the outer end. A recess 50 is provided along at least a portion of the height of the first arm 40 at a position which is spaced from the outer end. The second arm 42 is connected to and planar with the second wall 34 of the body 28 and is defined by an inner end which is proximate to the body 28, an outer end which opposite the inner end, a top surface 52 and inner and outer surfaces. A beveled surface 54 is provided between the top surface 52 and the outer end. A recess 56 is provided along at least a portion of the height of the second arm 42 at a position which is spaced from the outer end. The cavity 44 extends between the inner surfaces of the arms 40, 42 and is co-axial with the slot 30 in the body 28. A connecting wall 58 extends between the arms 40, 42 at their outer ends. The connecting wall 58 extends approximately the same height along the arms 40, 42 as the walls 32, 34 of the body 28. An upstanding support wall 60 extends upwardly from the connecting wall 58 and is spaced from the first and second arms 40, 42. An aperture 62, 62*a* is provided through each arm 40, 42 for receiving the latch 22 as discussed herein. The apertures 62, 62*a* are aligned with each other. A notch 64, 66, which is shown as v-shaped, is provided in the top surface 46, 52 of each arm 40, 42 and is spaced from the inner end of the respective arm 40, 42.

A first card engaging wall 68 is connected to the first arm 40 at the inner end thereof. A second card engaging wall 70 is connected to the second arm 42 at the inner end thereof. The second card engaging wall 70 is perpendicular to the second arm. The first and second card engaging walls 68, 70 are aligned with each other and define a card edge receiving slot 72 therebetween. The edges of the card 24 are held within the card edge receiving slot 72. The card edge receiving slot 72 is co-axial with the slot 30 in the body 28. Each card engaging wall 68, 70 has an upper surface which is beveled to promote entry of the card 24 into the card edge receiving slot 72.

Each latch 22 is similarly formed and is connected to its respective tower 38 in a similar manner. Therefore, only one of the latches 22 and its connection to its tower 38 is described, with the understanding that the other latch is similarly formed and connected to its tower in a similar manner.

As best illustrated in FIGS. 5-8, the latch 22 includes first and second arms 74, 76 which are joined together by a top wall 78, a rear wall 80 and a bottom push block 82. The arms 74, 76 are identically formed and therefore, only one of the arms 74 is described with the understanding that the other arm 76 is identically formed.

The arm 74 is defined by inner and outer opposite ends, a top end, a bottom end and inner and outer surfaces. The top end has a planar inner section 84 and a planar outer section 86 which is stepped downwardly from the inner section 84 a predetermined distance. The inner end has a planar upper section 88 and a planar lower section 90 which is stepped inwardly from the upper section 88 a predetermined distance. A shoulder 92 is formed between the upper and lower sections 88, 90. A planar flange 94 extends outwardly from the outer surface of the arm 74 and is parallel to the outer section 86. The flange 94 commences at the outer end of the arm 74 and extends toward the inner end a predetermined distance. An aperture 96 is provided through the arm 74 at a position which is vertically spaced above the flange 94. The apertures 96 in the first and second arms 74, 76 are aligned with each other. A detent 98 extends outwardly from the outer surface of an upper portion of the arm 74 and is spaced forwardly of the flange 94. A pin 100 extends outwardly from the outer surface of the arm 74 and is vertically spaced from the detent 98. The pins 100 in the first and second arms 74, 76 are aligned with each other.

The top wall 78 commences at the inner end of the arms 74, 76 and extends toward the outer ends of the arms 74, 76 a predetermined distance. The rear wall 80 extends between the inner surfaces of the arms 74, 76, proximate to the flanges 94. Support blocks 102, 104 are formed on the rear wall 80 proximate to the inner surfaces of the first and second arms 74, 76 such that a space is defined between the support blocks 102, 104. The push block 82 extends between the arms 72, 74 at the bottom end thereof and extends from the inner ends thereof. The push block 82 is used to eject the card 24 from engagement with the card edge receiving slot 72 in the tower 38 when the latch 22 is operated by the user.

The latch 22 is mounted to its tower 38 by placing the arms 72, 74 of the latch 22 between the arms 40, 42 of the tower 38 and engaging the pins 100 on the arms 72, 74 into the apertures 62, 62*a* provided through the arms 40, 42. The support wall 60 of the tower 38 extends between the arms 72, 74. The latch 22 can be pivoted relative to the tower 38 by rotation around the pins 100. When the latch 22 is in the card engaging position (non-pivoted), the shoulders 92 overhang the card edge receiving slot 72 in the tower 38. In addition, the detents 94 engage within the recesses 50, 56 in the tower 38. Without the provision of the locking member 26, the latch 22 can be moved to the card ejecting position by pivoting the latch 22 outwardly from the tower 38 provided sufficient force is applied to the latch 22 to overcome the engagement of the detents 98 and the recesses 50, 56.

To ensure that the latch 22 remains in the card engaging position, the locking member 26 is provided. The locking member 26 is mounted on the latch 22 and pivots with the latch 22. The locking member 26 engages with the tower 38 to prevent the pivoting movement of the latch 22.

As best illustrated in FIGS. 9-11, the locking member 26 includes a first and second legs 110, 112 which are connected together by a finger engaging wall 114. Each leg 110, 112 extends from the finger engaging wall 114 and terminates in a downwardly-turned barb 116, 118. The finger engaging wall 114 has an inner section 120 which is planar with the non-barb portions of the legs 110, 112 and an outer section 122 which extends upwardly therefrom. If desired, ridges (not shown) may be provided on the outer section 122 to enable a user to more easily grip the locking member 26. A wall 124 extends downwardly from the inner section 120 and is spaced from the legs 110, 112. The wall 124 has an upper section extending from the inner section 120 and a lower section extending from the lower end of the upper section. The lower section has a width (the distance between the legs) which is greater than the width of the upper section such that protrusions 126 are defined. A pair of spaced apart spring legs 128 extend downwardly and forwardly from the rear end of the finger engaging wall 114. Each spring leg 128 terminates in a ball-like end 130.

To engage the locking member 26 with the latch 22, the protrusions 126 are inserted into the respective apertures 96 through the arms 74, 76. The legs 110, 112 of the locking member 26 abut against the outer surfaces of the arms 74, 76 and the finger engaging wall 114 of the locking member 26 is spaced from the outer section 86 of the top surface of the latch 22. The ball-like ends 130 of the spring legs 128 sit on the respective flanges 94.

To lock the latch 22 into the card engaging position, the barbs 116, 118 on the locking member 26 engage within the notches 64, 66 in the top wall of the tower 38. As a result, the latch 22 is positively locked into the card engaging position and the locking member 26 must be disengaged from the tower 38 to release the latch 22.

To insert the card 24 into the card edge receiving slots 72 and the slot 30 in the body, each latch 22 must be moved out of the card-engaging position. To do so, a user depresses the outer section 122 of the finger engaging wall 114 and pulls outwardly on the locking member 26. The locking member 26 will pivot relative to the latch 22 by the protrusions 126 rotating within the apertures 96. Upon rotation, the spring legs 128 compress between the finger engaging wall 114 and the flanges 94. Because the locking member 26 is mounted on the latch 22 and can only move a limited amount relative to the latch 22, outward force on the locking member 26 causes the outward movement of the latch 22. The latch 22 pivots outwardly relative to the tower 38 once sufficient force is placed on the latch 22 to overcome the detents 98 engagement within the recesses 50, 56. As a result, the latch 22 is moved out of engagement with the tower 38 in the same motion used to unlock the locking member 26 from engagement with the tower 38. Once the downward force is removed from the locking member 26, the spring legs 128 resume their original shape and pivot the locking member 26 relative to the latch 22.

After the latches 22 are clear of the card edge receiving slots 72, the card 24 is inserted into the card edge receiving slots 72 and into the slot 30 in the body 28. The bottom edge of the card 24 engages with the push block 82 on the latch 22, thereby causing the latch 22 to pivot toward the card-engaging position. As the latch 22 and locking member 26 pivot, the inner end of the barbs 116, 118 contact the beveled surfaces 48, 54 of the tower 38 to cam the legs 110, 112 over the outer end of the tower 38. This causes the spring legs 128 to compress between the finger engaging wall 114 and the flanges 94. Once the barbs 116, 118 clear the beveled surfaces 48, 54 of the tower 38, the spring legs 128 resume their original shape and pivot the locking member 26 relative to the latch 22, thereby engaging the barbs 116, 118 into the notches 64, 66 in the top surface of the tower 38. The shoulders 92 on the arms 74, 76 engage within a cutout 132 in the side edges of the card 24 to secure the card 24 within the card edge receiving slot 72 and the slot 30 in the body 28.

To eject the card 24 out of the card edge receiving slots 72 and the slot 30 in the body 28, each latch 22 must be moved out of the card-engaging position. To do so, a user depresses the outer section 122 of the finger engaging wall 114 and pulls outwardly on the locking member 26. The locking member 26 will pivot relative to the latch 22 by the protrusions 126 rotating within the apertures 96. Upon rotation, the spring legs 128 compress between the finger engaging wall 114 and the flanges 94. Because the locking member 26 is mounted on the latch 22 and can only move a limited amount relative to the latch 22, outward movement of the locking member 26 causes the outward movement of the latch 22. The latch 22 pivots outwardly relative to the tower 38 once sufficient force is placed on the latch 22 to overcome the detents 98 engagement within the recesses 50, 56. The push block 82 pushes on the lower end of the card 24 to eject the card 24 from the slots 30, 72. Once the downward force is removed from the locking member 26, the spring legs 128 resume their original shape and pivot the locking member 26 relative to the latch 22. The connector 20 is then ready to accept another card.

The positive locking of the latch 22 into position by using the locking member 26 ensures that the card 24 inserted into the connector 20 will not accidentally be ejected under shock and vibration conditions.

It is to be understood that the terms "top", "bottom", "rear" and the like are used for convenience in explanation of the structure of the connector 20 and do not mandate a position in use.

While a preferred embodiment of the present invention is shown and described, it is envisioned that those skilled in the art may devise various modifications of the present invention without departing from the spirit and scope of the appended claims.

What is claimed is:

1. A connector for accepting an associated card, comprising:

a body having a slot capable of receiving the card and having opposite ends;

a tower provided at each end of said body, each said tower having a recess and a notch provided therein;

a pair of latches, each said latch having a pivot point for pivotal mounting to each said tower, each said latch having a push block for engaging with and disengaging from the associated card, each said latch maintaining engagement with said respective tower when the associated card is removed from the connector, each said latch including a detent which is engageable with the recess in the respective tower and being releasably therefrom, said respective detent being spaced from said respective pivot point; and a locking member provided on each said latch, said locking members being moveable relative to the respective latches, each said locking member having a barb engageable with the notch in the respective tower to prevent movement of said locking members relative to said towers, said barbs on said locking members being disenageable from said notches on said towers to allow movement of said locking members relative to said towers and to said latches, said detents on said latches being disenageable from said recesses in said towers to allow movement of said latches relative to said towers, said detents only being releasable from said recesses after said barbs have been released from said notches.

2. A connector as defined in claim 1, wherein each said locking member is pivotally mounted to said respective latch.

3. A connector as defined in claim 1, wherein each said latch includes a flange and each said locking member includes a spring leg engaged with said flange, said spring leg compressing when said locking member is moved relative to said latch.

4. A connector as defined in claim 1, wherein each said tower has a cam surface and each said barb has a curved surface which engages with said cam surface when said latch is moved toward said tower.

5. A connector as defined in claim 1, wherein each said tower is integrally formed with said body.

6. A connector as defined in claim 1, wherein said latches and said locking members are separate structures.

* * * * *